US005232555A

United States Patent [19]

Daunais et al.

[11] Patent Number: 5,232,555

[45] Date of Patent: Aug. 3, 1993

[54] WET CELLULOSIC WEB TRANSFER METHOD USING AIR DOCTOR BLADE

[75] Inventors: Robert Daunais, Dorion; J. David McDonald, Vaudreuil; Ian T. Pye; Ivan I. Pikulik, both of Pointe Claire, all of Canada

[73] Assignee: Pulp and Paper Research Institute of Canada, Pointe Claire, Canada

[21] Appl. No.: 839,436

[22] Filed: Feb. 24, 1992

Related U.S. Application Data

[63] Continuation-in-part of Ser. No. 497,705, Mar. 23, 1990, abandoned, which is a continuation-in-part of Ser. No. 250,840, Sep. 29, 1988, abandoned.

[51] Int. Cl.[5] ..... D21F 7/00; D21F 3/04

[52] U.S. Cl. ..... 162/193; 162/205; 162/281; 162/307; 34/117; 34/120

[58] Field of Search ..... 162/193, 194, 205, 207, 162/281, 283, 306, 307, 358, 360.1; 34/114, 116, 117, 120, 122, 123; 15/256.5, 256.51, 308, 316 R

[56] References Cited

U.S. PATENT DOCUMENTS

| | | | |
|---|---|---|---|
| 1,262,698 | 4/1918 | Pope | 162/306 |
| 2,958,379 | 11/1960 | Hornbostel | 162/318 |
| 3,879,257 | 4/1975 | Gentile et al. | 162/112 |
| 3,903,342 | 9/1975 | Roberts | 428/153 |
| 4,000,237 | 12/1976 | Roberts | 264/128 |
| 4,016,032 | 4/1977 | Kankaanpaa | 162/305 |
| 4,086,131 | 4/1978 | Rempel et al. | 162/203 |
| 4,087,317 | 5/1978 | Linkletter | 162/281 |
| 4,158,594 | 6/1979 | Becker et al. | 162/112 |
| 4,208,459 | 6/1980 | Becker et al. | 428/154 |
| 4,483,745 | 11/1984 | Wicks et al. | 162/205 |
| 4,543,160 | 9/1985 | Kerttula et al. | 162/193 |
| 4,815,220 | 3/1989 | Wedel | 162/193 |

FOREIGN PATENT DOCUMENTS

| | | | |
|---|---|---|---|
| 1044459 | 12/1978 | Canada . | |
| 1223143 | 6/1987 | Canada . | |
| 0254665 | 1/1988 | European Pat. Off. . | |
| 234713 | 5/1911 | Fed. Rep. of Germany . | |
| 1572200 | 5/1969 | France . | |
| 56-43160 | 10/1981 | Japan . | |
| 1078634 | 8/1967 | United Kingdom | 163/360.1 |
| 2158047 | 11/1985 | United Kingdom . | |

OTHER PUBLICATIONS

McDonald et al. "A New Web Transfer System for Closing the Drain Between the Last Press and the Dryer Section" Jan. 1990 Annual Mtg. Canadian P & P Assoc.

*Primary Examiner*—Karen M. Hastings

*Attorney, Agent, or Firm*—Millen, White, Zelano & Branigan

[57] ABSTRACT

A transfer system for transferring a moving wet cellulosic web between two moving elements of a paper machine without excessive sheet flutter or breakage, supports the web and permits higher web speeds than presently used. The transfer system comprises a suction roll that forms a nip in contact with the web on the surface of a roll or web supporting belt, a doctor blade positioned in contact with the surface of the roll or web supporting belt immediately after the nip to ensure the web separates from the surface, and an air jet adjacent the doctor blade that blows air in a direction substantially opposite the moving web, between the moving web and the surface of the roll or web supporting belt, to guide and support the web towards the suction roll.

19 Claims, 5 Drawing Sheets

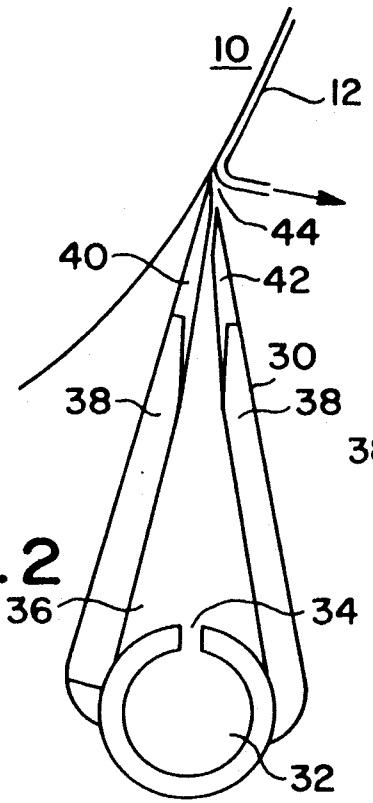
FIG. 2
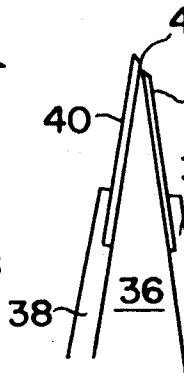
FIG. 3
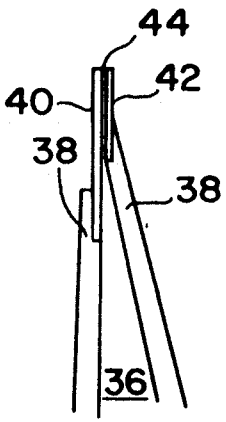
FIG. 4
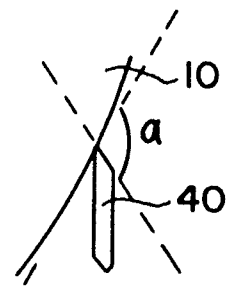
FIG. 5
FIG. 6
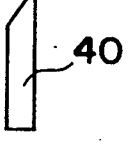
FIG. 7

WET CELLULOSIC WEB TRANSFER METHOD USING AIR DOCTOR BLADE

CROSS-REFERENCE TO RELATED APPLICATIONS

This application is a continuation-in-part of application Ser. No. 07/497,705, filed on Mar. 23, 1990, now abandoned, which is a continuation-in-part of U.S. application Ser. No. 07/250,840, filed Sep. 29, 1988, now abandoned.

FIELD AND BACKGROUND OF THE INVENTION

The present invention relates to the transfer and support of wet cellulosic webs between two moving elements in a paper machine. More specifically, the present invention relates to the detachment of moving wet cellulosic webs from a press roll or web supporting belt to another moving element in the press section or dryer section of a paper machine.

In the fabrication of paper, a suspension of cellulosic fibers, referred to as a furnish, is spread on one or more moving forming fabrics or carriers and the bulk of water drained away. This cellulosic web or sheet, which is initially weak and wet, is transferred onto a press felt which carries it into a press nip formed by two press rolls. The mechanical compression between the two press rolls compacts the web and eliminates part of the water from the wet web. The web usually leaves the press nip adhering to one of the press rolls, and must be peeled from the roll before it can be transferred to the next section of the paper machine. Paper machines generally have one to four presses in the press section followed by a dryer section with heated dryer rolls, to evaporate most of the water remaining in the pressed web. In the fabrication of some paper grades, the dry web is moistened by the application of an aqueous suspension of sizing agents. This occurs in a size press after a first drying stage, and the moist sized paper is then again transferred to a second dryer section where it is dried for a second time.

While in the different sections of the paper machine, the wet cellulosic web is usually supported by a pervious belt such as forming fabric, press felt, and drying fabric, or by other means such as a press roll. A mechanical support is often unavailable during web transfer between the individual moving elements of the machine. Thus during web transfer there is an increased danger of the web or sheet breaking, especially if it is moist and the machine operates at high speed. To reduce the danger of sheet breaks it is sometimes necessary to reduce the machine speed, even though this leads to a decrease in production. The danger of sheet breaks is sometimes reduced by the addition of chemicals or by increasing the proportion of a stronger, but more expensive, component such as chemical pulp or long fibre pulp in the furnish or initial fibre mix.

The most critical areas of sheet transfer are from the forming section to the press section, between the consecutive presses in the press section, and between the last press in the press section and the first roll in the dryer section. In all of these transfer areas, the web or sheet is still wet and thus is comparatively weak. Several methods have been used for transferring the sheet at these areas. In one method, the sheet is pulled unsupported from one element to the next through a so-called "open draw". The wet sheet in the open draw is unstable at high speeds and reacts to small variations in the process, sometimes having a tendency to oscillate or flutter. An excessive sheet flutter can cause deformations and wrinkling of the web and reduce the product quality or completely break the sheet and interrupt production. Thus, paper machines with an open draw between the former and the first press rolls usually operate at speed below 750 meters per minute.

All the machines operating at high speeds, that is to say in excess of 1,000 meters per minute, provide a continuous support of the web from the former to at least the first nip in the press section. On machines with multiple roll press arrangement, the web is continuously supported up to the second or third press nip. However, on all present paper machines, the sheet passes through an open draw as it is peeled from the roll of the last press.

In the open draw method of transfer, the reduction of excessive sheet flutter and stabilization of the web is sometimes achieved by increasing the tension in the web by increasing the speed differential between the machine elements. The tension required to peel the web and to stabilize it in the open draw transfer may, in some instances, be sufficiently great to cause a break in the web and even if it does not break, a high tension can permanently stretch the web and, therefore, make it more susceptible to breaks during the subsequent operations on the paper machine. This reduced extensibility is preserved even in the finished product and can lead to an increased number of paper sheet breaks during converting or printing operations.

The speed of paper machines has been increasing throughout the history of papermaking; however, not always at an equal rate. Several times in the past, the machine speed reached a level at which a technical innovation had to be introduced to make a speed increase feasible. For example, the open-draw between the former and the first press subjected the weak paper web to failure stresses and limited the machine speed to a maximum of about 750 m/min. This problem has been eliminated in the 1950's by the introduction of a so-called suction pick-up. In machines with this system, a vacuum roll wrapped by a press felt removes the moist paper web from the forming fabric and carries it into the first press. Paper machines in which the first open draw occurs only after the first press can reach speeds of up to about 800 m/min. Further speed increase was achieved in the 1960's by the introduction of three-roll inclined presses which closed the open draw between the first and second press. Machines with the open draw after the second press have since reached speeds up to about 1100 m/min. In the 1970's further speed increase was made possible by the introduction of four-roll, three-nip presses which closed the draw between the second and third press. Machines with this press arrangement are now operating at speeds greater than 1200 m/min. In the 1980's so-called "unifelted" dryer sections were introduced, which eliminated open draws between the wet-end dryers. In the machines built in recent years, all the open draws in the dryer section have been closed and the maximum speed of such machines approaches 1500 m/min. The open draw between the last press and the dryer section is the only remaining open draw of a modern paper machine. This last open draw must be eliminated before any further increase in machine speed can be achieved.

The need to improve the web transfer from the press section to the dryer section is widely recognized by the industry and much effort is presently being devoted to resolving this problem. As an example of this effort, we would like to list several recent patents which address the web transfer, in a different manner than our invention: U.S. Pat. No. 4,016,032, issued Apr. 5, 1977; U.S. Pat. No. 4,943,351, issued Jul. 24, 1990; U.S. Pat. No. 4,543,160, issued Sep. 24, 1985; and CA 1223143, published Jul. 23, 1987. In spite of all this effort, the problem of web transfer from the press section to the dryer section has not yet been resolved and, to our knowledge, no machine is completely free of open draws.

The importance of the open draw closure is illustrated by the following two examples. A major Canadian supplier of paper machines has prepared a proposal for the installation of a web-transfer system according to our invention for paper mills of two major paper manufacturers. The proposals are presently under consideration by the mills which belong to the world's leading pulp and paper companies.

It has been suggested that the vacuum transfer roll had been previously described in GB 1078634 (published in August 1967). In that patent, the vacuum roll was a press roll, while our invention teaches the application of a no-load transfer roll which only lightly contacts the press roll.

The suction presses such as that described in GB 1078634 cannot support a sufficiently high nip load to provide the desired degree of water removal and, therefore, today their application is only limited. For example, the latest survey of Canadian newsprint machines (I. I. Pikulik and T. H. Owston, Annual Meeting TS CPPA, Montreal, Canada, January 1992) revealed that none of the third presses had a suction roll. However, a main application of our invention is to close the open draw between the third presses and dryers.

The reduction of press nip pressure to optimize it for transfer would not lead to a desirable result. The main function of the press section is to increase the web solids content by mechanical means. The web solids content increase is affected by several parameters and, in particular, is proportional to the pressure in the press nip.

The nip pressure normally increases going from the first to second to third (and possibly to a fourth) press. In the work according to the instant invention, we have found that the application of low pressure in the last nip has a detrimental effect. For example, if the pressure in the last nip is lower than the pressure in the preceding nip, then the last nip removes no water from the web and furthermore some water is transferred from the press felt into the web. Such a result is contradictory to the main objective of web pressing, and is clearly unacceptable. During the work in accordance with the instant invention, it was discovered that if the nip pressure is almost completely eliminated and replaced by only light contact between the transfer roll and the press roll, web rewetting does not occur. This observation can be explained in the following manner. When the nip pressure is greater (such as in a lightly-loaded press nip) the felt is compressed sufficiently to become saturated with water, which is then transferred by capillary forces to wet paper. No such saturation of the nip occurs at very low nip loads. This observation was made during long and extensive research on pressing conducted in connection with the instant invention. The mechanism of rewetting by the felt is not known and would not be obvious to a person knowledgeable in the art of papermaking. Furthermore, if a press roll is used as a transfer roll, the paper sheet rewetting would continue even outside the nip, as long as the sheet adheres to the felt. The sheet moisture content could be increased by 3% or more, a severe penalty.

Another method of transferring a web from a pervious carrier or belt such as a forming fabric to another pervious carrier such as a press felt is with the assistance of a drilled roll equipped with a vacuum chamber. Most high speed paper machines use such a vacuum pick-up system to transfer the web from the former to the first press roll. In a vacuum pick-up system, however, a suction roll can only efficiently transfer a web from a pervious carrier to another pervious carrier. Press rolls are generally solid rolls and thus a vacuum system such as a suction roll cannot by itself initiate peeling of a web from a solid press roll or even an impervious belt. In the case of a press roll, the web normally adheres better to the smoother and less pervious surface.

Since separation of the leading edge of a wet web from a press roll or web supporting belt is difficult to achieve, paper machines are commonly initially threaded with only a narrow band of the web which is sometimes referred to as a "tail". When this narrow band has been successfully threaded through the length of the machine, it is gradually widened until the full width of the paper machine is achieved. This narrow band of paper is initially very weak because it is so narrow and air currents in fast running machines frequently cause the narrow strip to break, thus prolonging the start-up procedure. All the paper produced during machine start-up is unusable and must be recycled. If the machine threading time could be shortened and the machine threaded with the full width of the sheet or web, then production losses would be decreased and a higher efficiency achieved.

Undesirable materials, which generally represent fractions of cellulosic fibres, often adhere to various paper machine rolls such as press rolls, dryers or calender rolls, and are commonly removed by so-called "doctor blades" which have sharp edges positioned in close proximity to the surfaces of the machine rolls and scrape off the web and fibres adhering to the roll. The web removed in this manner is generally densely crimped or creped and cannot be converted into a smooth paper. Creping of a web by a doctor blade may be applied commercially to produce soft and bulky tissue paper used primarily for hygienic products. For high bulk and softness, it is desirable that the tissue paper have regularly and densely spaced creped ridges. Good creping requires a sharp doctor blade and an optimal contact angle between the blade and the impinging web. Canadian Patent number 1,044,459 and Japanese Patent Number 43160 disclose methods of creping by using a hollow doctor blade from which a flat jet of compressed air is blown from a location adjacent the blade. Both of these patents have as a primary objective, the reduction of the wear of the roll and the blade through a reduction or elimination of blade contact with the roll. These hollow doctor blades were designed for production of creped paper rather than for initiation of the transfer of a wet cellulosic web in the press section or immediately prior to the dryer section. Because creping occurs when a web is removed by a blade from a smooth surface, such as a press roll, doctoring has not been used as a means of transfer for wet cellulosic webs to produce paper which requires a smooth surface.

SUMMARY OF THE INVENTION

It is an aim of the present invention to provide an apparatus and method for the detachment of a wet cellulosic web from a press roll or web supporting belt and continuously support this web during its transfer to a subsequent moving element.

It is a further aim of the present invention to provide a transfer system which permits safe transfer of a tail or a full width sheet or web during the start-up of a paper machine. It is a still further aim to provide a transfer system to transfer a wet fibrous web at web speeds greater than 1,000 meters per minute. Yet a further aim is to transfer webs which are weaker than those transferred on existing paper machines without the necessity of having to increase wet web strength and to reduce the number of breaks that occur in conventional paper machines.

The present invention can be used to transfer a tail or a full width strip between a press roll or a web supporting belt to a following moving element and comprises a doctor blade to initially separate the web from the roll or carrier, an air jet that blows air in a direction opposite to the movement of the web, between the web and the roll or carrier, and a vacuum or suction roll that may have a pervious belt thereon to retain the web as it is transferred from the press roll or carrier.

The present invention provides a system to transfer a fast moving web of flexible material from a surface of a first web supporting moving element to a second web supporting moving element while continuously supporting said web during the transfer thereof, comprising in combination:

- a first web supporting moving element;
- a suction roll in a non-pressure contact with the web, defining a nip with the first moving element;
- a doctor blade in contact with the surface immediately after the nip to cause separation of the web from the surface; and
- means for producing an air jet adjacent the doctor blade, between the web and the surface and in a direction substantially opposite the direction of movement of the web, the air jets constituting means for separating the web from the surface of the first moving element and guiding it toward the suction roll.

In a preferred embodiment, a pervious belt moves through the nip, around the suction roll and the web is transferred to this pervious belt. The pervious belt may be a papermaking felt.

In another embodiment, the doctor blade and air jet comprise a unitary assembly with an air plenum connected to a tapered air chamber culminating in two lips with a gap between the lips forming an air jet. One of the two lips forming the doctor blade is positioned in contact with the surface of the roll or web supporting belt.

In yet another embodiment, the air plenum and air chamber form a unitary assembly, the assembly being movable between first and second positions, in the first position the assembly contacts the surface of the roll or web supporting belt so that the air jet therefrom is directed towards the nip formed by the press roll and suction roll, in the second position the assembly being positioned so that it is out of contact with the surface to avoid wear. In this second position, the assembly is not active and the air supply can be discontinued.

In a still further embodiment, there is provided in a method of forming a web of fibrous sheet material, including the steps of forming a wet web of cellulosic fibres, moving the web through a press section having a plurality of press rolls to a dryer section, the improvement of transferring the moving web from a press roll to a following moving element, comprising the steps of:

- feeding the moving web around the press roll through a non-pressure nip formed between the press roll and a suction roll;
- detaching the moving web from the press roll immediately after the nip by a combination of a doctor blade and blowing a jet of air in a direction counter to the moving web between the press roll and the web; and
- guiding and supporting the moving web to the following moving element by a combination of the air jet and suction from the suction roll.

BRIEF DESCRIPTION OF THE DRAWINGS

FIG. 2 is a partial side elevational view of a combined doctor blade and air jet according to one embodiment of the present invention;

FIGS. 3 and 4 are partial side views showing different shapes of air chambers for the combined doctor blade and air jet;

FIGS. 5, 6 and 7 are detailed side views showing different edges for doctor blades;

DESCRIPTION OF THE PREFERRED EMBODIMENT

Figure 1:
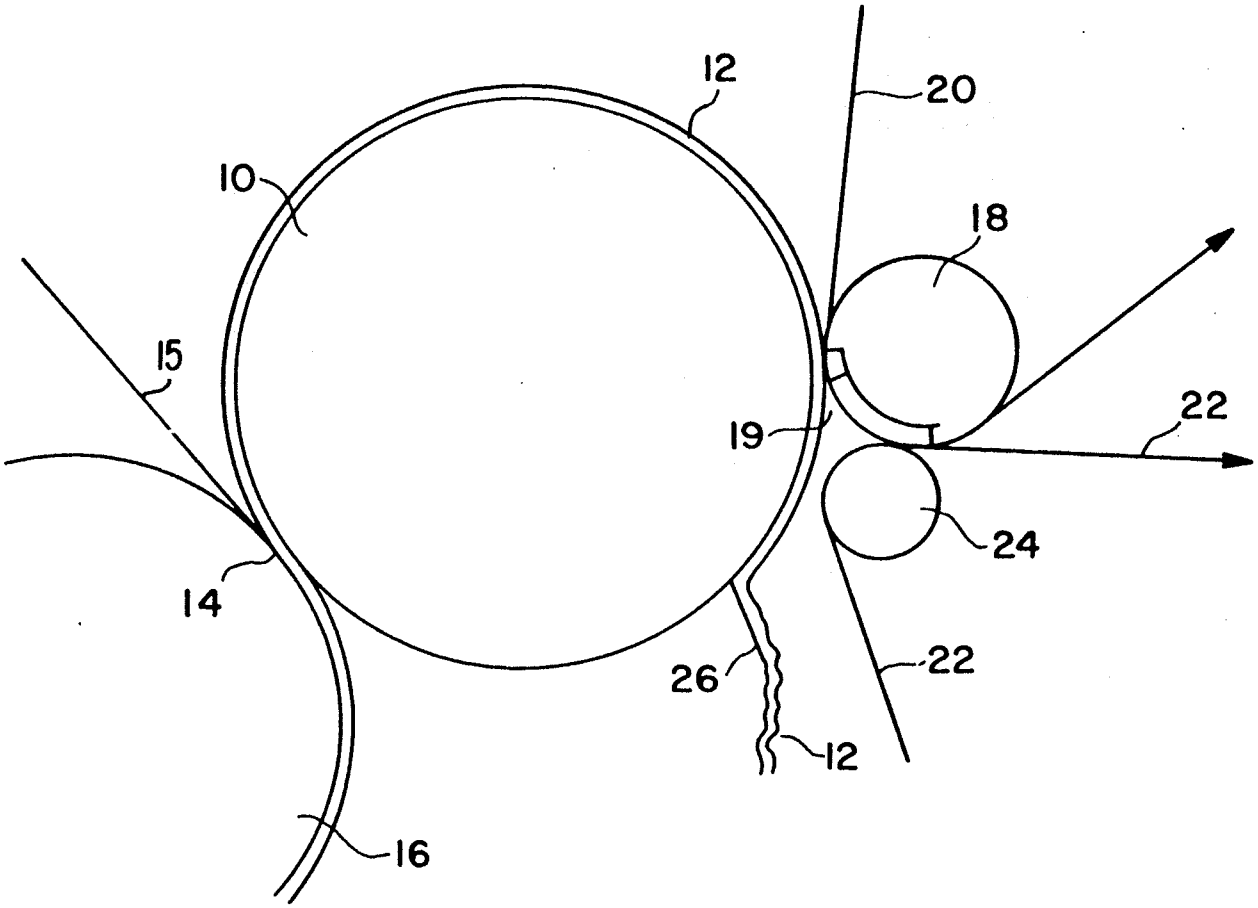
FIG. 1 PRIOR ART
FIG. 1 is a schematic side elevational view of a solid roll with a suction roll forming a nip and a roll cleaning doctor used by applicants in experiments leading to the instant invention.

Referring now to the drawings, FIG. 1 illustrates a solid roll 10, which is the last roll in a press section of a paper machine, with a web 12 of wet cellulosic fibres moving on the roll 10 from a nip 14 with the previous press roll 16 generally covered with a pervious belt 15. A suction roll 18 forms a nip 19 with the solid roll 10, and a pervious belt 20, in the form of fabric belt, moves around the suction roll 18 and through the nip 19. A second carrier belt 22, which is also pervious, is conveyed about a further roll 24 positioned beneath the suction roll 18 to provide a passage for the web 12 between the first carrier belt 20 and the second carrier belt 22. The suction roll 18 is to provide suction to separate the web 12 from the surface of the solid roll 10 and direct it between the carrier belts. However, because the solid roll 10 does not allow air to pass therethrough, the suction roll 18 has little effect in separating the web 12 from the solid roll 10. As can be seen in FIG. 1, the web 12 passes down to a conventional doctor blade 26 which separates the web 12 and crimps or crepes the web as it is separated from the roll 10. The arrangement of FIG. 1 did not provide satisfactory results.

A doctor blade and air jet assembly 30 are shown in FIG. 2 which comprises an air plenum 32 in the form of a pipe with a slot or a series of holes 34. Air passes into an air chamber 36 formed by two tapered walls 38 which taper down to a first lip 40 and a second lip 42. FIG. 2 shows the first lip 40 representing a doctor blade in contact with the surface of a press roll 10 so that the web 12 is shown to separate adjacent the doctor blade lip 40. The second lip 42 is shown to extend not so far as the first lip 40 and a gap 44 or slit between the two lips 40 and 42 provides a longitudinal air jet to eject a flat jet of air. Whereas the word "jet" has been used throughout the specification, this terminology includes a longitudinal stream of air as would be ejected by a gap or slit 44.

FIG. 3 shows one embodiment of an air chamber 36 wherein the tapered walls 38 join to a first lip 40 and a second lip 42 which converge inwards to the gap 44 at the ends of the lips 40 and 42. FIG. 4 shows another embodiment wherein the two lips 40 and 42 are parallel to each other, thus the gap 44 represents a parallel gap and provides a flat jet of air therefrom.

FIGS. 5, 6 and 7 represent different tips of the doctor blade lip 40. The contact angle $\alpha$ as shown in FIG. 5 being similar to that used on conventional blades wherein the edge of the blade scrapes the roll surface. One or both lips of the assembly may be replaced if the lip or lips are damaged or worn.

The optimum gap width depends on production parameters such as machine speed, product grade, web adhesive force, etc. The gap width between the two lips may be between 0.1 and 3.0 mm wide, and preferably is in the approximate range of 0.3 to 0.8 mm.

Figure 8:
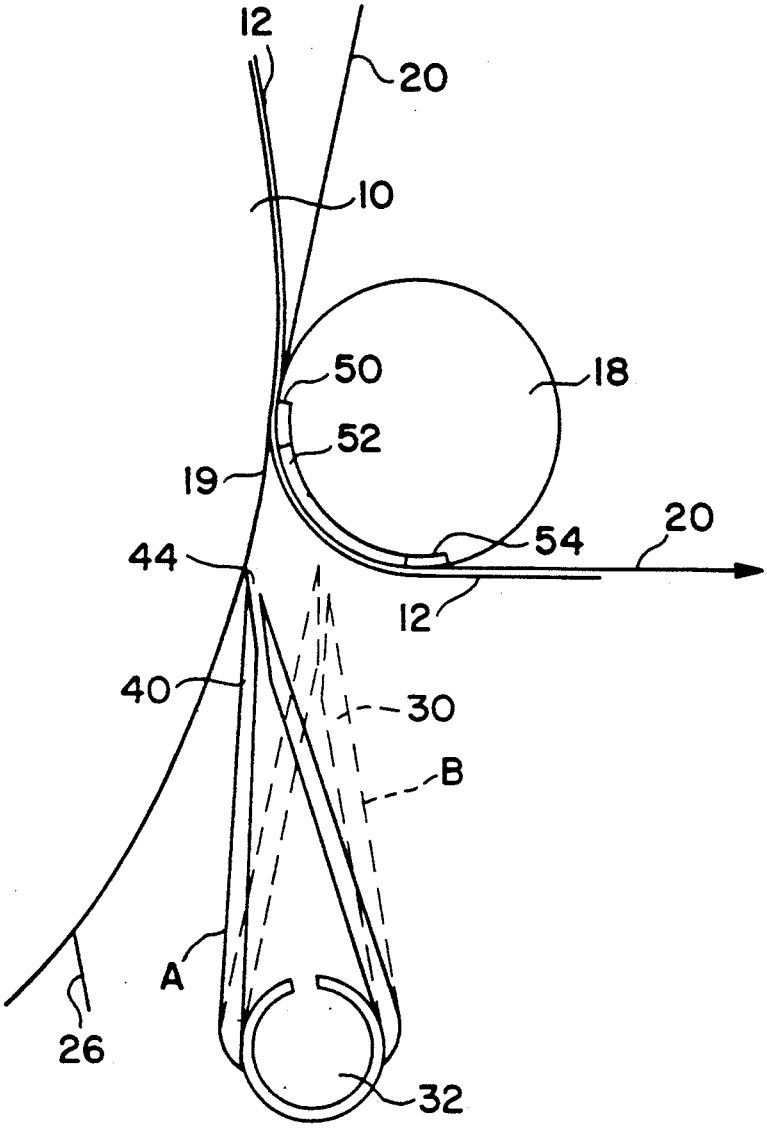
FIG. 8 is a partial side elevational view showing a combined doctor blade and air jet positioned adjacent to a solid roll forming a nip with a suction roll.

FIG. 8 shows a suction roll 18 positioned above the doctor blade and air jet assembly 30. In the initial phase of the start-up procedure, the assembly 30 is in position A and the leading edge of the tail or full machine width of web 12 is detached from the roll 10 by impact with lip 40 of the doctor blade. The web 10 is then forced by the air jet towards the suction roll 18 and is attracted to the roll surface by the vacuum within the suction roll 18. The web 12 is thus transferred to the felt 20. Once the moving web 12 has been transferred to the felt 20, the assembly 30 is no longer required and is switched to position B and the air supply shut off. If a web break occurs, the web is rethreaded with the assembly 30 in position A. During an operating period of anticipated web breaks, the assembly is left in position A.

The suction roll 18 is shown having three zones. The first zone 50, located nearest to the nip 19, has a high vacuum level to assist in establishing the initial contact between the web 12 and the felt covered suction roll 18. The second zone 52 downstream from the first zone 50 is a larger zone and acts as a holding zone with a lower vacuum level. For example, the first zone 50 may have a vacuum level in the range of about 10 to 80 kPa and the second zone 52 has a vaccum level in the range of from 0 to 50 kPa. The second zone 52 is sufficient to maintain and support the web 12 on the felt 20. If it is required, the third zone 54 might provide a small positive air pressure to ensure that the web 12 on the felt 20 is later easily parted from felt 20 and to assist transfer to further elements such as belts 22, 60 and 70.

Since the suction roll 18 forms part of a system whose basic function is to transfer a web from a plain roll 10 to another section of the paper machine, the amount of pressure at the nip between the rolls 10 and 18 is very small as it is not desired to press the web to alter its characteristics, such as the solids content. Throughout the claims and the specification, the wording "non-pressure contact" and "non-pressure nip" will be used to describe the near absence of pressure at the contact area between the roll 18 and web so as not to change the web characteristics and similarly, the very low loading of the nip defined between the rolls 10 and 18, respectively. These are relative terms and should be construed by taking as a reference the considerable pressure developed in a press nip for the purpose of extracting water from the web, which is incommensurably higher than the pressure at the nip between the rolls 10 and 18.

The air pressure in the air plenum 32 depends on production variables such as doctor gap, width, machine speed, product grade and the web adhesion to the roll, but preferably ranges from about 14 kPa to 600 kPa. The most convenient air pressure for an air blade with a gap width of 0.5 mm was found to be between 34 kPa and 100 kPa.

Figure 9:
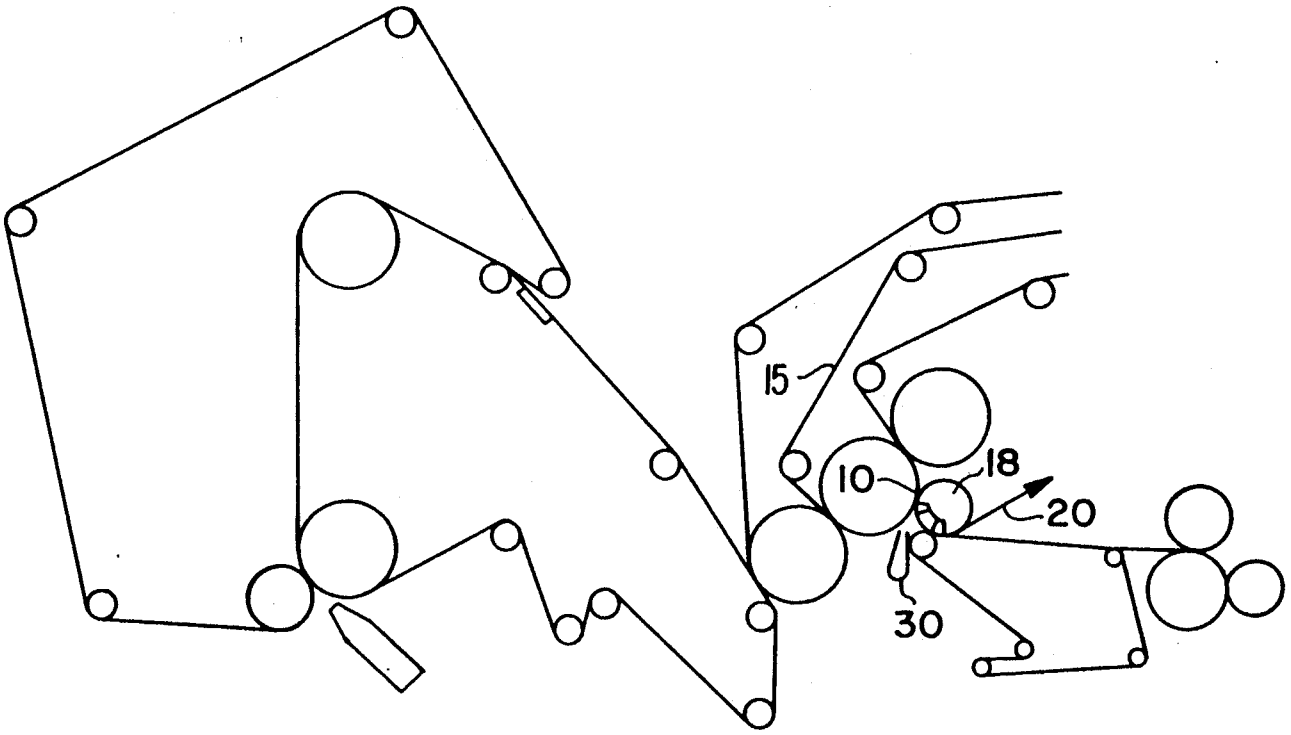
FIG. 9 is a schematic side elevational view of an experimental paper machine showing the transfer system of the present invention positioned to transfer a web from the last roll of the press section.
Figure 10:
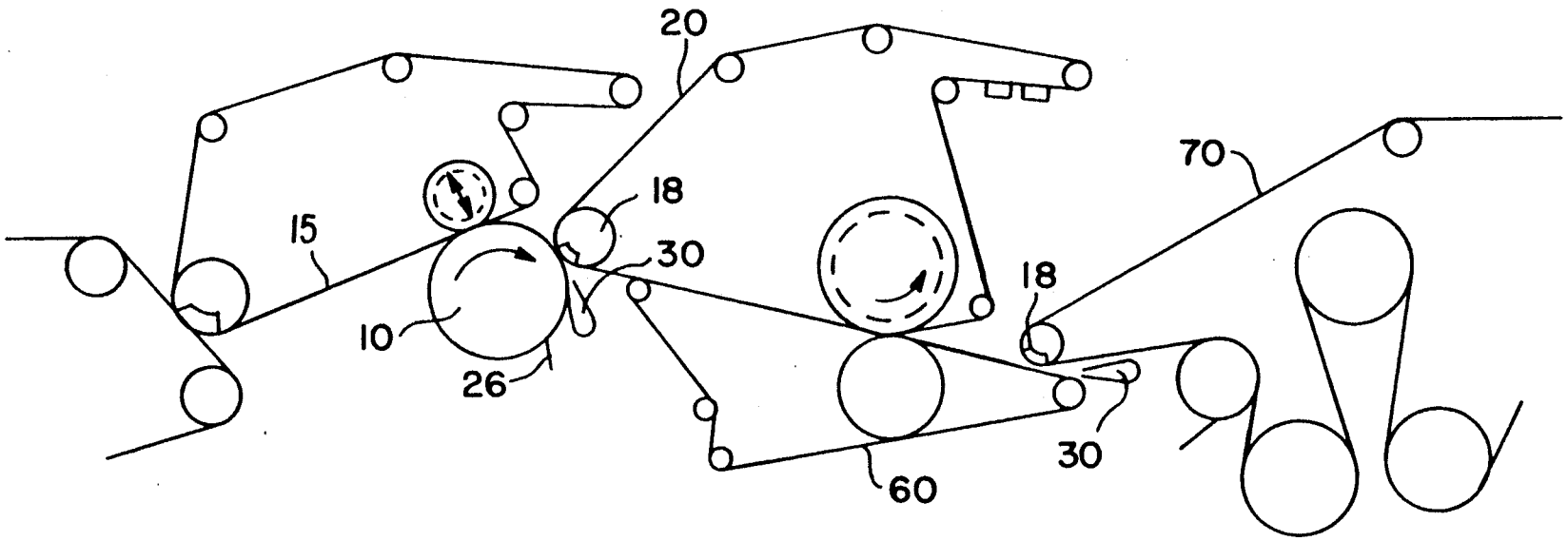
FIG. 10 is a schematic side elevational view of yet a further embodiment of a transfer system according to the present invention wherein the transfer occurs between an impervious web supporting belt and a pervious dryer fabric.

FIG. 9 illustrates the transfer system of the present invention used to transfer the web from the plain roll 10 of the last press which is the central roll of a three roll inclined press. FIG. 10 illustrates two transfer systems, the second of which transfers from a pervious or impermeable web supporting belt 60 onto a dryer felt 70. The device could be used for the transfer of various flexible thin materials and is particularly suitable for the transfer of weak and extensible sheets such as wet paper or paperboard, dry creped hygienic paper or non-woven products.

Important features of our patent are judiciously located air jets and a pervious-textile-wrapped, vacuum transfer roll, which forms a non-pressurized nip with the press roll. The air jet separates the web from the press roll and the suction roll traps the web to the pervious textile which supports it during the transfer to the next machine element. A correct distance between the air jet and the nip is crucial for the proper operation of the system. The transfer system, according to our invention, is capable of transferring not only a narrow tail of the web, but also the full machine width. Because the transfer roll is in firm, though not pressurized, contact with the press roll, the open draw is completely eliminated.

Novel principles of the disclosure include five main factors: (a) the location and direction of the air jets with respect to the doctor, (b) the placement of the air/doctor unit with respect to the nip and suction roll, (c) the consequent short distance for the web to travel from the doctor to the felt-covered suction roll, (d) some of the prior art of combinations of air, suction and doctors and (e) the possibilities of full sheet width transfer.

a) Location and Direction of the Air

Air issuing from a nozzle rapidly becomes turbulent and carries a light sheet with irregular variations in velocity and direction. This technique is conventional and satisfactory for the purpose of transporting a sheet in approximately the direction desired.

There are current approaches directed to controlling the initial flight of a flapping tail and subsequently stabilizing the draw when the transfer has been achieved, and indeed this is what was attempted in our initial experiments set forth in FIG. 1 It was unexpectedly found that, whereas we were unable to obtain efficient transfer of the moist sheet at high speed with a suction roll alone, with a doctor and air jet alone or in discouraging attempts with the doctor, air jet and suction roll together, by combining the actions as described in the disclosure and positioning the device immediately after the nip, a remarkable improvement in reliable operation was achieved. For successful operation of the transfer system, it is necessary that a proper "air knife" is formed by a well-designed air-doctor and that the air knife is directed at a proper angle toward the paper-bearing solid roll, at a proper distance from its nip with the transfer roll. It also became possible and preferable to transfer the full width of the web rather than a tail. An additional advantage is that this achieved the design of unit that would function alone, avoiding having an operator manipulate the air jets in dangerously close proximity to the machinery.

Often air jets located on the doctor are placed there to use a convenient support rather than to act in close cooperation with the doctor in the manner we have found important. A closer comparison to the instant invention would be that disclosed by Gladish (GB 1078644) who supplied air to cooperate with the doctor; however, Gladish supplied the air to float the blade out of contact with the surface.

b) Placement of the Air/Doctor Unit with Respect to the Nip

In accordance with the instant invention, the web must be detached immediately after the roll/paper/felt nip to permit effective attachment to the felt over the vacuum zone. The experiments according to the instant invention indicate that this is advantageous for two reasons: the first is to maintain laminar flow from the nozzle as far as possible so that any turbulence that develops is still of small scale and secondly so that the web is detached from the roll and doctor uniformly. Unexpectedly, it was found that this ensures that the web does not flutter or flap unduly and leads to a much more reliable capture by the suction of the roll. The precise location of the mechanical components and the velocity and volume of air delivery have been found to be dependent on the operating conditions such as the nature of the web, the roll, the felt and the speed; the most effective arrangement will be found by trial and error by the operator. However, it has been found essential to situate the transfer doctor and air jet immediately after the nip.

c) Travel Distance from Doctor to Felt

When removed by a doctor from a surface to which it is adhering, the web is usually creped (as is desirable for tissue quality) or badly deformed. This does not matter for those techniques in which the tail is trapped by other machine components so that the web is eventually pulled away from the doctor. Although similar behavior is observed with the device of the instant invention, because of the short distance, a flat web is quickly delivered to the suction roll; this is most desirable in permitting a differential suction holding pressure to develop between the surface of the web and the felt.

d) Combinations of Air, Suction and Doctors—Prior Art

While compressed-air nozzles, drilled compressed-air pipes, suction rolls and pervious textiles are commonly used in papermaking, the particular arrangement of some of these elements, in a manner that permits closure of an open draw on a paper machine involves a significant inventive step.

In conventional systems, the air used to blow a tail is likely to be very turbulent. Even a large scale of turbulence is acceptable in such conventional systems because the objective is to ensure that the tail is trapped by downstream machine elements (threading ropes or bands). When the tail has been engaged thus, the transfer will become established and the tail will eventually adopt the desired run. In accordance with the principles of the instant invention, the need for such machine elements is eliminated.

If the velocity and volume of air are sufficient and directed under the side edges of the tail adhering to the roll, a doctor is not required; however, it is extremely difficult to dislodge the tail by breaking through the web's surface.

This conventional procedure limits the practical widths of the tail to below about 250 mm especially at high machine speeds and, although the air flows are very irregular and frequently rupture the sheet, the tail can eventually be directed to the desired location with difficulty.

e) Full Width Transfer

It is a common procedure at machine start up, or after each sheet break, to thread the machine first with a 0.25 m wide ribbon of paper, sometimes called "tail," on one side of the machine. Only when the machine is threaded and the sheet is stabilized is this ribbon gradually expanded to the full sheet width which might be, for example, 9 m. The narrow ribbon is inherently unstable, and frequently wrinkles or breaks. Therefore, the procedure might be repeated a number of times before the production is resumed.

A tail is usually generated by piercing the moist web, usually on the forming fabric, with a movable jet of high pressure water. The water jet can splash fibrous suspension onto machine clothing, creating a need for special precautions or cleaning. Thus, avoiding the need for a tail would be advantageous.

Before the introduction of pick-up transfer from the former to the first press, the threading by the ribbon was initiated at the former. Since the introduction of pick-up transfer, the entire width of the sheet can be transferred at once from the former to the press section. The narrow ribbon of web is used to thread the machine starting from the press section. On the other hand, the introduction of our transfer system allows a whole-width sheet transfer from the press section into the dryer section. Since the modern dryer sections are already self-threading, the full width sheet is transferred from the former, all the way to the end of the dryer section. This revolutionary development results in a considerable decrease in the production loss associated with threading the machine.

Many transfer systems are aimed at controlling the tail, and cannot be modified to allow for full-width sheet threading. A sheet transfer through an open draw is too unstable for threading the machine with a full-width sheet. However, the elimination of the open draw, superior design of the unit, a proper location of these elements and a judicious choice of air pressure makes the full-width threading in accordance with applicants' invention possible.

In the prior art, suction press rolls were commonly used on all presses of slower paper machines which were used about 50 to 20 years ago. Since the shell of such a roll was weakened by dense drilling, the roll could support only a limited nip load, which led to inefficient water removal. Therefore, suction rolls are not used on the heavily loaded second and third presses of fast, modern machines. With the instant invention, a web transfer system closes the last open draw on fast paper machines which do not have suction rolls in their final presses, and thus eliminate the hurdle for further speed increase.

While various hand-held of fixed air jets have been commonly used to direct a ribbon of paper through an open draw during threading of the machine, at higher machine speeds, these devices become inefficient. Under these conditions, the threading procedure is often repeated several times which leads to unacceptable production loss. The system according to our invention is capable of transferring the web immediately each time, even at very high machine speeds. Therefore, the application of the system increases the machine efficiency by eliminating breaks which occur in the open draw, by eliminating the production loss during prolonged attempts to rethread the machine, and by creating conditions for increasing the machine speed.

While various web transfer systems are described in the prior art patent literature, none of them is capable of eliminating the open draws from the machine's wet end. Therefore, these systems do not remove the area in which the sheet is frequently broken or damaged, which causes difficulties in threading. the sheet stretched in the open draw also has less desirable properties, as shown in Table I of this application.

None of the alternative systems is capable of transferring the entire width of the web. Thus, the application of our system eliminates production losses associated with threading of the machine by a narrow ribbon of paper.

Experiments have shown that a vacuum transfer roll alone cannot remove the sheet from a press roll, especially not at higher machine speed. The web transfer can only be accomplished by proper application of the air doctor and the transfer roll. Therefore, any system based on the vacuum transfer roll alone would not be successful.

EXAMPLE 1

A pilot paper machine was used to make paper in two different ways. Paper was first made with a direct transfer from the press section using the air doctor transfer roll arrangement of the present invention, and secondly, paper was transferred from the solid roll using the conventional open draw operation. The tensile properties of the paper so made were then compared.

The pilot machine consisted of a roll former with a suction pick-up, a three-roll inclined press and a sampler as illustrated in FIG. 9. The transfer system was installed between the second press nip and the sampler as shown in FIG. 9. The paper machine was producing a web 0.33 meters wide with a basis weight of about 50 grams per square meter at 800 meters per minute using a newsprint furnish. The first and second press nip loads were 60 and 120 kN/m respectively, and the solid content of the paper after the second press was approximately 42%.

The wet paper used for the laboratory test was reeled with minimum draw (less than 1%) for the air doctor transfer roll experiments and at several draws between 2 and 4% for the open draw experiments. The experimental results are shown in the following table.

TABLE

Paper Stretch
(Open draw versus air doctor - transfer roll arrangement)

| Draw % | STRETCH % Wet Paper ** Stretch % | Dry Paper * Stretch % |
|---|---|---|
| 2.1 | 3.1 | 1.4 |
| 2.1 | 3.6 | 1.4 |
| 2.2 | 3.0 | 1.2 |
| 2.4 | 3.9 | 1.2 |
| 3.2 | 3.7 | 1.2 |
| 4.0 | 2.7 | 1.2 |
| 0.0 + | 4.4 | 1.5 |

* Sample size 1.5 × 10 cm
** Sample size 2.5 × 10 cm
Strain rate 100 mm/min
\+ Using air doctor-transfer roll arrangement $$\text{Draw} = \text{Speed of } \frac{(\text{Sampler}) - (\text{Second Press})}{(\text{Second Press})} \times 100\%$$

The wet stretch measurements were done on samples cut from the reel (2.5×10 centimeters) sealed in a bag, and handled in such a way to reduce moisture loss. Other samples were dried between blotters in a photographic dryer and cut in strips (1.5×10 centimeters). Both wet and dry samples were strained at 100 mm per minute in a laboratory tensile strength tester. The measurements on both the wet and dry paper demonstrate that the paper produced with a transfer arrangement according to the present invention had more stretch than that produced using the open draw system. These results indicate that the paper is less likely to break in subsequent open draws on the paper machine and in the converting or printing process.

EXAMPLE 2

Using the arrangement shown in FIG. 9, a 45 gram per square meter web was successfully transferred to the sampler at 1,000 meters per minute ten times for ten attempts. After sheet transfer was initiated by the transfer system of the present invention, it was maintained even when the air supply to the air jet was interrupted. Without the application of the present transfer system, the transfer of a web having the full machine width could not be accomplished by experienced machine operators.

EXAMPLE 3

Using the transfer system described herein, a web of full machine width was transferred from the press to the sampler of a pilot paper machine at its maximum speed of 1,200 meters per minute. Without this transfer system, this could not be accomplished.

The transfer system described and claimed herein is capable of transferring weak wet webs, such as those made from 100% mechanical pulps. In the past, this has not been possible without forfeiting speed or having to add a percentage of chemical pulps. Thus the present invention permits the manufacture of paper from weaker and less expensive starting materials.

When practising the transfer system described herein, the number of web breaks is reduced and the speed of the paper machine can be increased above the highest speeds of conventional machines, in the order of about 1,400 meters per minute.

Whereas FIG. 9 shows only a single transfer system, multiple transfer assemblies may be provided at different locations on the machine.

Various changes may be made to the embodiments described herein without departing from the scope of the present invention which is limited only by the following claims.

What is claimed is:

1. In a method of forming a web of fibrous material into paper, the improvement comprising the steps of:

providing a wet paper web of cellulosic fibers consisting of only mechanical pulp, the wet paper web having a longitudinal extent;

advancing the wet web in a longitudinal direction at high speed in the range of at least 800 to 1400 meters per minute from the beginning through the end of a press section having a plurality of press rolls and a final press roll at the end of the press section;

transferring the wet web while moving from the press section to a dryer section having a beginning and an end through a non-pressure nip formed between the final press roll at the end of the press section and a suction roll at the beginning of the dryer section, a pervious belt moving around the suction roll and through the non-pressure nip so as to wrap the suction roll;

effecting initial transfer at said speed range from the press section to the dryer section upon starting and restarting the step of advancing the wet web by a) providing a full width leading edge of the wet web with a width equal to the width of a cross-section taken perpendicular to the longitudinal extent of the web;

b) detaching the leading edge of the wet web from the press roll immediately downstream of the non-pressure nip by engaging the full width leading edge with a doctor blade in engagement with the press roll downstream of the non-pressure nip;

c) supporting the full width leading edge on an air jet dispensed proximate the doctor blade in a direction counter to the longitudinal direction in which the wet web advances, wherein said air jet is formed by an air plenum coupled to a tapered air chamber culminating in two lips with a gap between the lips forming the passage for the air jet, one of the two lips forming the doctor blade which cooperates with the air jet for detaching the moving web; and d) while supporting the full width leading edge on the air jet, guiding the full width leading edge to the pervious belt wrapped suction roll by the combined influence of the air jet and suction from the suction roll.

2. The method of claim 1 further comprising the steps of maintaining contact of the doctor blade with the press roll and operation of the air jet only during initial transfer of the full width leading edge and during operating periods of anticipated web breaks.

3. The method according to claim 1, wherein said two lips have the same length.

4. The method according to claim 1, wherein one of said two lips forming said doctor blade is longer than the other lip.

5. The method according to claim 1, wherein said jet of air is formed between adjacent walls of the two lips as the lips converge inward to said gap.

6. The method according to claim 1, wherein adjacent walls of said two lips are parallel prior to said gap.

7. The method according to claim 1, wherein the width of said gap forming the air jet is in the approximate range of from 0.1 to 3.0 mm.

8. The method as defined in claim 7, wherein the pressure in said air plenum is in the approximate range of from 14 to 600 KPa.

9. A method as defined in claim 1, wherein said air plenum and said air chamber form a unitary assembly, and further comprising the steps of moving the assembly between first and second positions, contacting said roll surface in said first position and not contacting said roll surface in said second position.

10. In a method of forming a web of fibrous material into paper, the improvement comprising the steps of:

providing a wet paper web consisting of newsprint furnish, the wet paper web having a longitudinal extent;

advancing the wet web in a longitudinal direction at high speed in the range of at least 800 to 1400 meters per minute from the beginning through the end of a press section having a plurality of press rolls and a final press roll at the end of the press section;

transferring the wet web while moving from the press section to a dryer section having a beginning and an end through a non-pressure nip formed between the final press roll at the end of the press section and a suction roll at the beginning of the dryer section, a pervious belt moving around the suction roll and through the non-pressure nip so as to wrap the suction roll;

effecting initial transfer at said speed range from the press section to the dryer section upon starting and restarting the step of advancing the wet web by a) providing a full width leading edge of the wet web with a width equal to the width of a cross-section taken perpendicular to the longitudinal extent of the web;

b) detaching the leading edge of the wet web from the press roll immediately downstream of the non-pressure nip by engaging the full width leading edge with a doctor blade in engagement with the press roll downstream of the non-pressure nip;

c) supporting the full width leading edge on an air jet dispensed proximate the doctor blade in a direction counter to the longitudinal direction in which the wet web advances, wherein said air jet is formed by an air plenum coupled to a tapered air chamber culminating in two lips with a gap between the lips forming a passage for the air jet, one of the two lips forming the doctor blade which cooperates with the air jet for detaching the moving web; and d) while supporting the full width leading edge on the air jet guiding the full width leading edge to the pervious belt wrapped suction roll by the combined influence of the air jet and suction from the suction roll; wherein the resultant paper has wet and dry stretch measurements exceeding those of similar paper produced in open draw machines.

11. The method of claim 10 further comprising the step of maintaining the contact of the doctor blade with the press roll and operation of the air jet only during initial transfer of the full width leading edge and during operating periods of anticipated web breaks.

12. The method according to claim 10, wherein said two lips have the same length.

13. The method according to claim 10, wherein one of said two lips forming said doctor blade is longer than the other lip.

14. The method according to claim 10, wherein said jet of air is formed between adjacent walls of the two lips as the lips converge inward to said gap.

15. The method according to claim 10, wherein adjacent walls of said two lips are parallel prior to said gap.

16. The method according to claim 10, wherein the width of said gap forming the air jet is in the approximate range of from 0.1 to 3.0 mm.

17. The method as defined in claim 16, wherein the pressure in said air plenum is in the approximate range of from 14 to 600 KPa.

18. A method as defined in claim 10, wherein said air plenum and said air chamber form a unitary assembly, and further comprising the steps of moving the assembly between first and second positions, contacting said roll surface in said first position and not contacting said roll surface in said second position.

19. The method of claim 10, wherein the web is advanced at a rate of about 1400 meters per minute.

* * * * *